United States Patent [19]

Barra

[11] Patent Number: 4,789,155

[45] Date of Patent: Dec. 6, 1988

[54] COMPETITIVE REACTION-TIME GAME TOY

[76] Inventor: James M. Barra, 14802 N. Florida Ave., Tampa, Fla. 33613

[21] Appl. No.: 90,856

[22] Filed: Aug. 31, 1987

[51] Int. Cl.[4] ..... A63B 67/00

[52] U.S. Cl. ..... 273/1 GE

[58] Field of Search ..... 273/1 G, 1 GE, 88, 138 A, 273/139, 138 R, 366, 367, 369, 370; 434/258

[56] References Cited

U.S. PATENT DOCUMENTS

| | | | |
|---|---|---|---|
| 1,267,220 | 5/1918 | Heckmann | 273/1 GE |
| 2,141,948 | 12/1938 | Bruso | 273/1 GE |
| 2,204,397 | 6/1940 | Barrett | 273/1 GE |
| 2,995,371 | 8/1961 | Nuson | 273/1 GE |
| 3,717,347 | 2/1973 | Hottendorf | 273/1 GE |

*Primary Examiner*—Leonard E. Smith
*Assistant Examiner*—Leonard P. Walnoha
*Attorney, Agent, or Firm*—Charles A. McClure

[57] ABSTRACT

A competitive game toy for one or more players, dependent on personal reaction time and hand-eye coordination. Players manually trigger the driving of a movable indicator along a path having successive intervals marked with award indicia of any desired game or sport, and also manually halt the indicator therealong. The indicia may be point scores or instructions to add or delete turns or for simulated playing of a game or sport, such as baseball. The players, striving to be awarded a high score or good play, try to stop the indicator along path intervals with favorable indicia.

24 Claims, 2 Drawing Sheets

FIG. 5
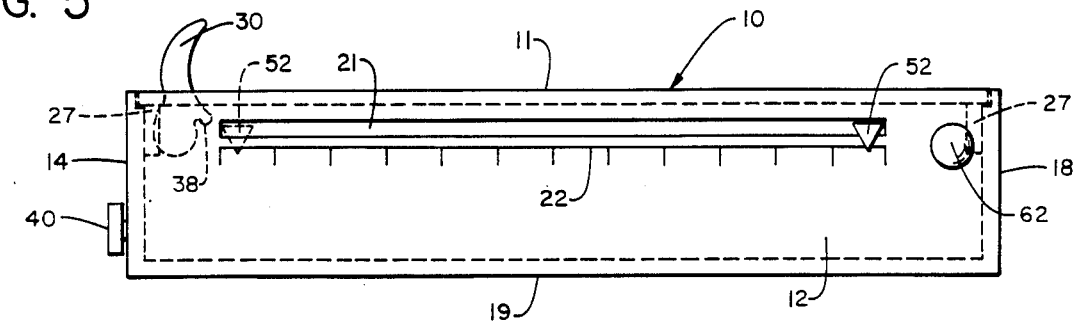
FIG. 6
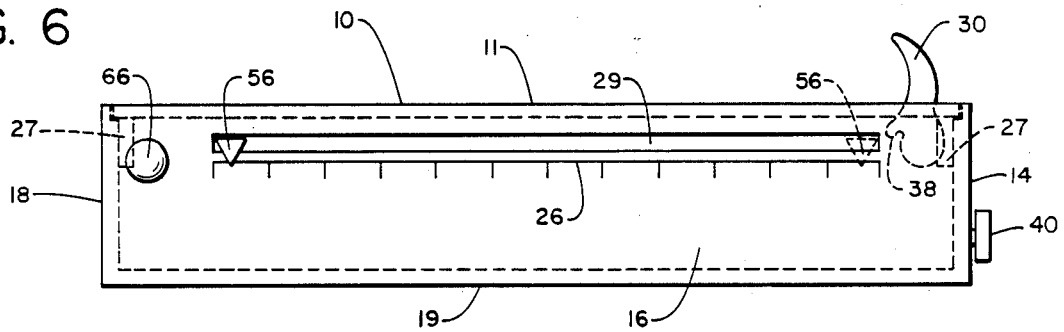
FIG. 7
71A
| | | | | | | | |
|---|---|---|---|---|---|---|---|
| +5 | −10 | +1 | +1 PLAY | −1 PLAY | +10 | +20 | −10 |
FIG. 8
71B
| | | | | | | | | | | | |
|---|---|---|---|---|---|---|---|---|---|---|---|
| −10 | +5 | −5 | +2 | −2 | +10 | −10 | +2 | −2 | +5 | −5 | +10 |
FIG. 9
75A
| | | | | | | | | |
|---|---|---|---|---|---|---|---|---|
| INTENTIONAL WALK | CONTACT | WILD PITCH | STRIKE | BALL | CONTACT | STRIKE | BALL | CONTACT |
FIG. 10
75B
| | | | | | | | | | | | |
|---|---|---|---|---|---|---|---|---|---|---|---|
| HOME RUN | OUTFIELD FLY | GROUND-RULE DOUBLE | GROUND OUT | SINGLE | POP FLY | BUNT SAFE | LONG SINGLE | BUNT OUT | FOUL FLY | TRIPLE | DROPPED FOUL |

COMPETITIVE REACTION-TIME GAME TOY

FIELD OF THE INVENTION

This invention relates to a toy for playing a competitive game such as a simulated sport, alone or with one or more opponents, and concerns especially a time-reaction toy having a manually triggered indicator that is also manually arrested for selecting points to be scored or plays to be made.

BACKGROUND OF THE INVENTION

Competitive game toys diverge toward two diverse classes, game boards with chance-related play determinants (e.g., dice, spinners) and complex structurally modeled simulations, such as car or horse races. A gap exists for game toys with which players may exercise an important physical skill to determine plays in simulated sports and game points otherwise. One such skill is hand-eye coordination; another is reaction rate. My competitive game toy is designed to improve such physical skills, while leaving considerable scope for mental prowess in playing a simulated sport or other game of skill.

SUMMARY OF THE INVENTION

In general, the objects of this invention are attained via drive means adapted to be manually triggered to traverse movable indicator means along at least one path divided into successive intervals, and stop means adapted to be manually actuated to halt the indicator therealong. The drive means is controlled by manual setting and releasing of trigger means and by manual actuation of the stop means, usually before the drive means has traversed the indicator means from end to end along such path.

A primary object of the present invention is to improve each player's hand-eye coordination and rate of reaction.

Another object of this invention is to provide a competitive game toy usable by either one player, two players, or even more than two players.

A further object of the invention is to make such toy suitable for players of low, intermediate, and high physical skill levels by providing ready adjustability of the indicator traversing rate.

Other objects of this invention, together with methods and means for accomplishing the various objects, will be apparent from the following description and from the accompanying drawings of a preferred embodiment and variants thereof, which are presented here by way of example rather than limitation.

BRIEF DESCRIPTION OF THE DRAWINGS

FIG. 5 is a side elevation of a first side of the same toy, as indicated at V—V on FIG. 1;

FIG. 6 is a side elevation of the same toy from the opposite side, as indicated at VI—VI on FIG. 1

FIG. 7 is an elevation of a first embodiment of game indicia for the front side of this toy;

FIG. 8 is a like view of a first embodiment of game indicia for the rear side of the same toy;

FIG. 9 is a like view of a second embodiment of game indicia for the front side of this toy; and FIG. 10 is a like view of a second embodiment of game indicia for the rear side of the toy.

DETAILED DESCRIPTION OF THE INVENTION

Figure 1:
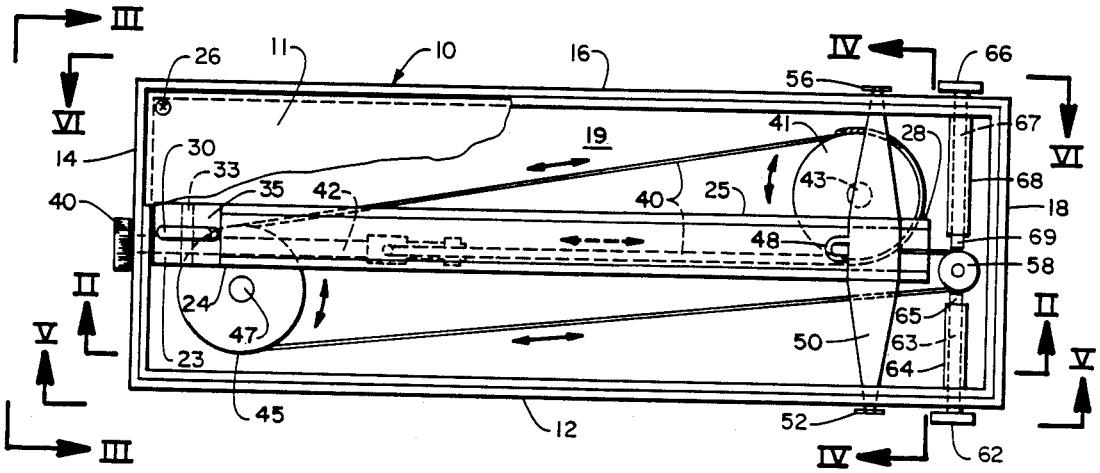
FIG. 1 is a top plan view, mostly sectioned away to reveal interior components of a game toy of the present invention.

Housing 10 of the toy of this invention conveniently has a rectangular parallelepipedal shape with flat top 11 and bottom 19, front sidewall 12, left endwall 14, rear sidewall 16, and right endwall 18. The housing contains much of the trigger means, and the drive means, indicator means, and stop means.

Figure 2:
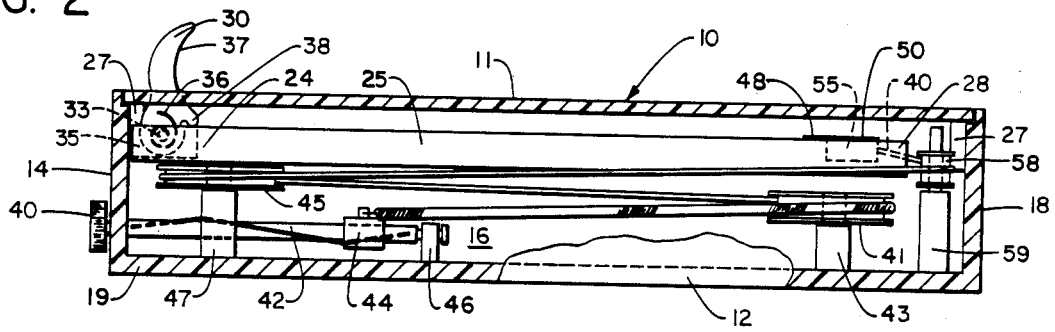
FIG. 2 is a front side elevation, mostly sectioned away to reveal the interior of the same toy, as taken at II—II on FIG. 1.

FIG. 1 shows such housing in plan. Its top panel 11, mostly cut away here, is held at the corners by screws 27' (one visible) into underlying bores 27 (shown in FIG. 2 and successive views). FIG. 2 shows the same housing with near wall 12 also mostly absent.

Centered between front wall 12 and rear wall 16 is open-top track 25 of the drive means. The track is secured at its left end 24 to housing left wall 14, leaving its right end 28 spaced near right wall 18. Support block 35 of the trigger means is fixed in the left end of the track and carries trigger 30 thereon upright on pivot pin 33. The trigger extends in a crescent shape above the top of the housing, with its concave face or grip 37 facing right, and biased clockwise toward the set position by torsion spring 36. Detent 38 at the lower right part of the trigger is adapted to fit (when set) into eye 48 of the drive means on intervening diamond-shaped part 50 of the indicator means, shown here at the right.

At the left, in FIGS. 1 and 2, just outside the housing, is tension-adjustment knob 40 of the drive means, which is attached to control screw 42 (shown schematically) extending underneath the track somewhat less than half the track length to terminate in supporting journal 46 upstanding from bottom 19 of the housing. This screw is rotatable to adjust therealong the longitudinal location of sleeve 44, connected to one end of drive cable 40 (shown in broken lines). The cable is elastically extensible over at least part of its length, conveniently the part between the end of the adjustment screw and pulley 41 at the right.

Under the right end of the track (FIGS. 1, 2) cable 40 wraps substantially a half turn about pulley 41 on support 43 upstanding from the bottom of the housing and offset between the track end and wall 16; then the cable extends obliquely for most of the housing length and wraps substantially a half turn about pulley 45, which is similarly mounted on upstanding support 47 at a somewhat higher level just underneath—and offset from—the left end of the track toward wall 12; and then the cable extends obliquely and nearly parallel to its previous oblique segment to wrap almost a half turn about small roller 58 mounted on upstanding support 59 between free end 28 of the track and wall 18.

The indicator means includes diamond-shaped winglike part 50, shown supported on slide 55 near rightmost end 28 of the track. Such winglike part extends laterally from above the track to and just past front and back sides 12 and 16 of the housing (FIG. 2), where it terminates in downturned pointer-like ends 52 and 56. Slide 55, inside the track, has affixed to it the end of cable 40 from about adjacent small roller 58. The opposite edge of the winglike part carries eye 48 into which detent 34 of the trigger means engages to set the trigger when the indicator is returned manually to the set position--stretching the extensible portion of the cable and thereby increasing the tension in it.

At the extreme right in FIGS. 1, 2 are pair of shafts 63, 67 extending through respective sleeves 64, 68 from respective stop buttons 52, 56 at the outside to terminate at free ends 65, 69, where friction can be applied to cable 40 to halt its travel after trigger 30 has been pivoted by application of manual pressure to its grip 37, thereby lifting detent 38 out of eye 48 on the near edge of the winglike means, freeing the extended cable to retract.

Figure 3:
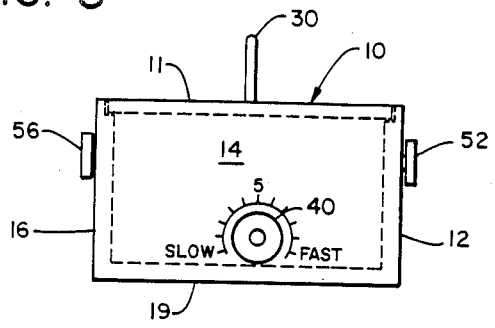
FIG. 3 is an end elevation of this toy, taken as indicated at III—III on FIG. 1.

FIG. 3 snows housing end 14, with adjustment knob 40, shown as making nearly a whole turn from slow through "5" to fast on the adjacent scale, intended to correspond to full travel of slide 44 the length of screw 42—which rotates as the knob is turned. Near the facing end, grip 37 or trigger 30 protrudes above the top 11 of the housing. Closer to the far end, indicator pointers 52 and 56, carried by winglike indicator part 50, closely flank sides 12 and 16.

Figure 4:
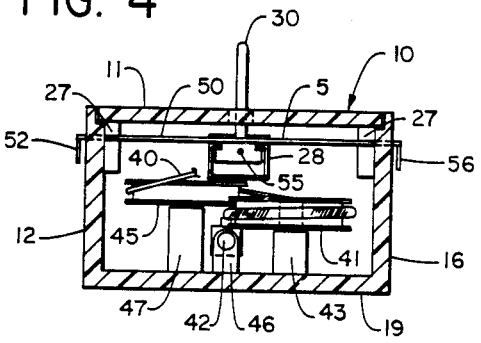
FIG. 4 is a sectional transverse elevation of the same toy, taken near one end thereof, as indicated at IV—IV on FIG. 1.

FIG. 4 shows the pulleys and the path of the cable thereabout in an endwise sectional view looking straight back down the track from the free end 28 thereof. In this view, pulley 41 is lower and on the right, whereas pulley 45 is at an intermediate level and on the left, while winglike part of the indicator means is above both pulleys. The sectioned top, bottom, and sides of the housing are shaded for plastic, although wood and metal would be acceptable housing compositions instead of or in addition thereto.

FIG. 5 shows long side 12 of the toy housing in elevation. Visible paralleling top 11 and bottom 29 (closer to the former) is slot 21 through which the near end of the wing part protrudes and terminates in downturned pointer 22, below which is parallel game indicia panel 22—blank here. At the right of the view, near end 18 and between side 12 and the viewer, is stop means 62, and at the left of end 14 is cable length-adjustment knob 60. Shown in broken lines at the left end of slot 21 is pointer 52, which is its alternative set position before the trigger is pressed.

FIG. 6, which shows long side 16 in like manner as FIG. 5 shows long side 12, is physically a mirror image of FIG. 2 but with most of the reference numerals different, of course. Thus, visible paralleling top 11 and bottom 29 (closer to the former) is slot 29 through which the near end of the wing part protrudes and terminates in downturned end 56, which points toward parallel game indicia panel 26—blank here. At the left of the view, near end 18 and between side 16 and the viewer, is stop means 66, and at the right of end 14 is cable length-adjustment knob 60. Shown in broken lines at the right end of slot 29 is pointer 56, which is its alternative set position before the trigger is pressed.

No special materials of construction are required in the practice of this invention. A rubber band or helical extension spring is suitable for the drive means. The part of the cable contacted by the stop means may be specially coated, cored, or wrapped for ease of stopping and for increased durability, and the ends of the stop means made rough or pointed, for example. Leather is durable and is readily halted by pointed stop means.

Operation of the game toy, insofar as described, is readily understood. If the trigger is not set, a user of the toy holds the housing at the bottom or at the end near the trigger with one hand, takes the pointers between thumb and finger of the other hand and forces them—and the rest of the indicator means—back upstream, i.e., toward the end near the trigger, stretching and thereby tensioning the extensible part of the cable in the process.

During the setting of the trigger, as the eye on the slide of the indicator means encounters the curved edge or the trigger detent, the trigger will pivot against its spring bias sufficiently to admit the eye to be engaged by the detent (or the trigger can be held open momentarily by the player's other hand) whereupon the bias then forces the detent into the eye, holding the drive means in the set or ready position.

Whenever the user applies sufficient manual pressure to its concave grip, the trigger pivots and thereby releases the eye of the indicator means, whereupon the extended cable retracts so that the drive means traverses the indicator means rapidly toward the opposite end or the track. During the brief travel time of the triggered indicator means, the user may undertake to halt it before the indicators reach the downstream end of their slots, by pressing one or both stop buttons so forcibly as to bind the cable against the roller. However, if the user's reaction time is too slow, the pointers may well reach the end of their path before the user succeeds in stopping them. Practice should speed up the reaction so as to enable the indicators to be halted sooner.

The game aspects of the toy relate to the user's ability to halt the indicator means as it is driven by the drive means, so that the pointer(s) will point to a desirable outcome on the indicia panel(s) provided as award means just underneath and paralleling the pointer travel slot(s). Convenient division of the indicia panel(s) into at least about a half dozen and at most about a dozen intervals enables such indicia as game points, play steps, or other instructions to be identified with whatever indicia interval is pointed to by either particular pointer when halted by a player pressing on one or both stop buttons.

FIGS. 7 and 8 show a first or "point score" embodiment, and FIGS. 9 and 10 show a second or "baseball" embodiment of indicia panels for the respective front and rear sides of the game toy of this invention, it being understood that only one side need be used but that use of both sides enables a game to be made more intricate and, therefore, more likely to remain interesting.

For each game one or more appropriate award means strips are selected by the player(s) and are secured in register with the indicia marks on the toy walls. Guides may be added on the walls to retain the panels in place. Alternatively, the backs of the panels or the receptive parts of the walls may be coated with a reusable adhesive, or both may be covered with mating "Velcro" strips or the like to permit frequent changing of such panels.

One user may play in solitary competition or skill training, releasing the trigger, stopping the pointer(s), noting the award, resetting the trigger, and so on—using one or two indicia panels as may be preferred. Alternatively, two users may play against one another by passing the game toy back and forth between plays, usually only one play each if using only one award means indicia panel but usually more plays each if using two indicia panels.

It will be understood that, when there is only one player, an added play (when awarded) may be taken simply by taking another turn with the same indicia panel or, if desired, with an available second indicia panel. Also, although a single indicia panel can be replaced by another between plays, it is distracting and slows the game to do so, so two indicia panels in place continuously are more convenient--except whenever the game in use is to be changed.

FIG. 7 shows indicia panel 71A divided into eight separate intervals labeled "+5, −10, +1, +1 play, −1 play, +10, +20, −10."

FIG. 8 shows indicia panel 71B having a dozen intervals: "−10, +5, −5, +2, −2, +10, −0, +2, −2, +5, −5, +10."

Play using the award means of either or both of FIGS. 7 and 8 is apparent. With only the indicia panel of FIG. 7, a single player takes successive turns and preferably keeps a running point score. With the indicia panel of FIG. 8 added, the same player uses such second source of point scores when the first indicia panel awards another turn. When there are two (or more) players, they play the first panel alternately, resorting to the second panel before relinquishing the toy to the opponent only when awarded another turn on the first panel.

FIG. 9 shows indicia panel 75A having indicia pertinent to the batter's situation in relation to pitches in baseball: "intentional walk, contact, wild pitch, strike, ball, contact, strike, ball, contact." Players will understand that "contact" means the bat struck the ball—the outcome of which is to be decided separately by another play on a second indicia panel, as in the next view, either by the same or a different player.

It will be apparent that, where the game is baseball, the toy preferably has two award panels alongside two respective indicator paths, one with instructions simulating offensive play and another with instructions simulating defensive play. A lone player plays successively both offense and defense along the respective paths. Alternatively, when there are two players, they play respective offensive and defensive play-simulating instructions for a while. Usually the respective positions are reversed after every three outs, corresponding to team changes between batting and fielding.

FIG. 10 shows indicia panel 75B with "contact" indicia: "home run, outfield fly, ground-rule double, ground out, single, pop fly, bunt safe, long single, bunt out, foul fly, triple, dropped foul." It will be understood that every fly is an out unless noted as dropped—when it is a single unless noted foul (when it is a strike, and play resumes on panel 75A). A runner on second base cannot score on an ordinary single or a ground-rule double—but runners on base advance two bases on a long single or a regular double. A game board showing a baseball diamond in plan can be furnished along with baseball player pieces, etc.

It will be further apparent that this game toy can be adapted to other two-sided games, such as tennis or soccer, by appropriate changes in the indicia panels; and to many-sided games, as well, such as arbitrary journeys with various hazards and rewards.

Regardless of whether a player is simply competing with the toy—so to speak—or himself or herself (when playing alone) or is competing against one or more other persons, the degree of difficulty can be selected by setting the tension adjustment knob appropriately. A high setting increases the tension and, thus, produces a more rapid rate of travel of the indicator pointers when triggered, thereby increasing the level of skill required to stop either one at a desired location along the award indicia.

A preferred embodiment and variants of the game toy of the present invention have been shown and described. Other changes may be made in such apparatus and procedures, as by adding or deleting, subdividing or combining, or otherwise modifying parts or steps, while retaining at least some of the advantages and benefits of this invention—which itself is defined in the following claims.

I claim:

1. Competitive game toy, comprising drive means including a spring traversing triggered indicator means along a given path, stop means manually actuated to halt the indicator means on the path, and award means adjacent indicator stopping places therealong.

2. Toy according to claim 1, including manual trigger means for the drive means to traverse such indicator means along such path.

3. Toy according to claim 1, wherein such award means includes at path intervals specific play instructions for a game.

4. Competitive game top, comprising drive means traversing triggered indicator means along a given path, including two indicators apart from one another but traversed simultaneously thereby, stop means manually actuated to halt the means along the path, and award means adjacent indicator stopping places therealong.

5. Toy according to claim 4 including two such award means, a separate one for each of such indicators.

6. Competitive game toy for one or more players, comprising indicator means traversable horizontally along a given path from end to end, drive means triggerable to traverse such indicator therealong, trigger means manually actuated to trigger the drive means, and stop means manually actuated to halt the indicator on the path.

7. Toy according to claim 6, including award means adjacent such path and extending therealong, 8. Toy according to claim 7 wherein such award means include game instructions at intervals corresponding to stopping places of such indicator therealong.

9. Toy according to claim 7, wherein such game is a simulated sport, and such instructions are for plays conventional therein.

10. Competitive game toy for one or more players, comprising indicator means traversable along a given path from end to end, including two such indicators and two such award means, a separate such award means for each such indicator, drive means triggerable to traverse such indicators therealong, trigger means manually actuated to trigger the drive means, and stop means manually actuated to halt the indicators along the path.

11. Competitive game toy for one or more players, comprising indicator means traversable horizontally along a given path from end to end, drive means triggerable so to traverse such indicator means, trigger means manually actuated to trigger the drive means, stop means manually actuated to halt the indicator on the path, and housing means substantially surrounding the foregoing means and having openings therein exposing to the exterior such indicator means, such trigger means, and such stop means, respectively.

12. Toy according to claim 11, wherein such trigger means has a manually engageable member protruding through such an opening to the exterior of the housing.

13. Toy according to claim 11, wherein such stop means has a manually engageable member protruding through such an opening to the exterior of the housing.

14. Toy according to claim 11, wherein such path is defined by an elongated opening to the exterior of such housing.

15. Toy according to claim 11, wherein such indicator means has a pointer member visible within such path-defining opening.

16. Competitive game playing for one or more players, comprising the steps of manually triggering drive means traversing indicator means horizontally along a given path divided into successive length intervals, visually observing the horizontal travel of such indicator means, manually actuating stop means to halt the indicator means within such a path interval, and performing a subsequent step pursuant to an instruction located adjacent the stopping place of the indicator means.

17. Game playing according to claim 16, wherein the subsequent step corresponds to a play in a simulated conventional sport.

18. Competitive game playing for one or more players, wherein the indicator means includes a plurality of indicators traversable along more than one set of instructions, and including selecting another such indicator and instruction set for one or more plays therealong after one or more plays along the first such indicator and instruction set.

19. Game playing according to claim 18, played by a sole player, who plays along the respective indicators and instructions set in succession.

20. Game playing according to claim 18, played by two or more players, who take turns, each player playing along a given one of the indicators and instruction sets.

21. Competitive game playing by one or more players, comprising the steps of manually setting a trigger for drive means traversing indicator means horizontally along a given path divided into successive length intervals, manually releasing such trigger to traverse the indicator means along at least part of such path, visually observing the horizontal travel of such indicator means, and manually stopping such indicator within such a path interval.

22. Competitive game playing by one or more players, comprising the steps of manually setting and then releasing a trigger for drive means traversing indicator means along a given scale divided into successive intervals, wherein the indicator means includes a plurality of indicators traversable along more than one scale, and wherein the respective scales have unlike sets of instructions therealong for a simulated sport and including the step of selecting a particular scale to be observed during each particular play.

23. Game playing according to claim 22, wherein the game has two scales, one with instructions simulating offensive play and the other with instructions simulating defensive play, and one player successively plays both offense and defense along the respective scale.

24. Game playing according to claim 22, wherein the game has two paths, one with instructions simulating offensive play and the other with instructions simulating defensive play, and two players alternately play along the respective paths, one each, corresponding to playing offensive and defense, respectively, for at least part of each game.

* * * * *